US005568872A

United States Patent [19]

Hinnant, Sr.

[11] Patent Number: 5,568,872

[45] Date of Patent: Oct. 29, 1996

[54] EYEGLASS HOLDER

[76] Inventor: Wayne M. Hinnant, Sr., 534 S. Conestoga St., Philadelphia, Pa. 19143

[21] Appl. No.: 453,218

[22] Filed: May 30, 1995

Related U.S. Application Data

[63] Continuation-in-part of Ser. No. 305,196, Sep. 13, 1994, abandoned.

[51] Int. Cl.[6] ..... A47F 7/00

[52] U.S. Cl. ..... 211/13; 211/205; 211/113; 248/902

[58] Field of Search ..... 211/12, 13, 205, 211/196, 113, 181, 119; 248/195, 902, 339; D6/458

[56] References Cited

U.S. PATENT DOCUMENTS

| | | | |
|---|---|---|---|
| D. 250,619 | 12/1978 | Newman | D6/458 |
| D. 320,025 | 9/1991 | Horrall | D16/129 |
| D. 328,085 | 7/1992 | Rickabus | D16/129 |
| D. 336,484 | 6/1993 | Morrow et al. | D16/129 |
| D. 337,338 | 7/1993 | Chang | D16/129 |
| 620,175 | 2/1899 | Pinault | 211/181 X |
| 853,762 | 5/1907 | Botsford | 211/205 |
| 1,089,290 | 3/1914 | Thompson | 211/205 X |
| 2,593,356 | 4/1952 | Smith | 211/119 |
| 2,723,765 | 11/1955 | Meredith | 211/119 |
| 3,195,731 | 7/1965 | Bowmar | 211/13 |
| 3,269,554 | 8/1966 | Jay | 211/119 |
| 3,552,701 | 1/1971 | Montagano | 248/309 |
| 3,777,894 | 12/1973 | Swenson | 211/13 |
| 3,817,392 | 6/1974 | Bloch | 211/13 |
| 4,429,797 | 2/1984 | Collins | 211/119 |
| 4,976,532 | 12/1990 | Nyman | 351/158 |
| 5,000,410 | 3/1991 | Beavers | 248/205.3 |
| 5,082,225 | 1/1992 | Nespoli | 248/231.8 |
| 5,087,105 | 2/1992 | White | 211/13 X |
| 5,141,104 | 8/1992 | Morrow et al. | 206/5 |
| 5,144,345 | 10/1992 | Nyman | 351/158 |
| 5,260,726 | 11/1993 | Nyman | 351/158 |
| 5,337,904 | 8/1994 | Goldberg | 211/13 |
| 5,340,074 | 8/1994 | Porcaro | 248/309.1 |

FOREIGN PATENT DOCUMENTS

| | | | |
|---|---|---|---|
| 739207 | 10/1955 | United Kingdom | 211/119 |

*Primary Examiner*—Robert W. Gibson, Jr.
*Attorney, Agent, or Firm*—Eckert Seamans Cherin & Mellott

[57] ABSTRACT

An eyeglass holder for convenience placement of eyeglasses has a pair of vertically spaced horizontal arms on a vertical support piece that can have a lower base or one or more upper hooks. The upper and lower horizontal arms are vertically offset less than the spacing between the eyeglass earpiece hinges. The upper arm is dimensioned to fit between the upper-hinged earpiece and the lens frame when that earpiece is folded against the lens frame. The lower arm forms an abutment that keeps the lower-hinged earpiece closed in a manner that does not interfere with placing or removing the eyeglasses from the holder. An upward-opening notch on the upper horizontal arm and an aligned forward-opening notch on the lower arm, prevent lateral displacement of the eyeglasses. The holder can be arranged to stand on a table or the like, or to hang, for example, from the rear-view mirror of an automobile.

16 Claims, 3 Drawing Sheets

EYEGLASS HOLDER

CROSS REFERENCE TO RELATED APPLICATION

This is a continuation-in-part of copending application Ser. No. 08/305,196, filed Sep. 13, 1994, now abandoned.

BACKGROUND OF THE INVENTION

1. Field of the Invention

This invention relates to devices for holding eyeglasses for convenience or display. In particular, an eyeglass holder has a protruding first limb that supports the eyeglasses at one of the two earpiece-to-lens frame pivot joints while the eyeglasses are folded closed, and a second limb below the first that maintains the earpieces folded closed. The eyeglass holder can be supported by a stand, for example on a horizontal surface such as a dresser or dash board, or can be provided with a hanger, such as for hanging on the rear view mirror of an automobile.

2. Prior Art

Eyeglasses are generally kept by users in eyeglass cases, i.e., elongated envelopes that often are padded. Such storage means are apt for protecting the eyeglasses, but render the eyeglasses somewhat inaccessible. Many users do not use such cases, for example to hold sunglasses that may be needed while driving, or to rest their eyeglasses overnight. Instead, the glasses are left on a nightstand, on the car dashboard, tucked under the car visor, etc. The glasses are then more accessible, but also are less protected and can slide about or fall. It would be advantageous to provide an eyeglass holder that protects the glasses while keeping them accessible and ready for use at a known location.

Devices for storing eyeglasses for sale display or for convenient access for use are known in various types, some for holding the eyeglasses with the earpieces folded, and some with the earpieces open. One form of known eyeglass holder, for example as shown in U.S. Pat. Nos. 5,141,104 and Des. 336,484—Morrow et al., has openings slightly larger than the earpieces and into which the earpieces are inserted, whereupon the earpieces can be folded. Eyeglass holders of this type require some care when inserting the earpieces to align and insert the earpieces in the holder. Care must also be taken when removing the eyeglasses from the holder. For this reason, this type of holder is most suited to displays for sale of eyeglasses rather than for storing them temporarily for convenient access.

Eyeglass holders from which the glasses can be hung for temporary convenience storage are known, as disclosed for example in U.S. Pat. Nos. Des. 328,085—Rickabus; Des. 320,025—Horrall; and 5,000,410—Beavers. These eyeglass holders have an opening for one of the earpieces, into which the earpiece is extended vertically downwardly until the holder engages the eyeglasses at the hinge joint between the lens portion and the earpiece. The glasses fold down and the earpiece and lens part rest on opposite sides of the holder.

Eyeglasses can be hung from one hinge substantially as they would be hung over a plain rod or wire. A difficulty with this arrangement is that the earpieces tend to pivot open, especially the earpiece at the hinge that is not placed in the holder. Structures are provided according to Rickabus and Beavers including a first opening into which the earpiece is extended vertically downwardly as described above, and a second opening into which the endmost part of the other earpiece is inserted so that it cannot pivot open. However, inserting the second earpiece is awkward and requires attention and care, such that the holders are not easily used by the driver of a car while driving, or by a nearsighted drowsy person searching for his or her glasses after waking up.

It would be advantageous to provide a different form of eyeglass holder that is more suitable for temporary convenience storage of glasses.

Another type of prior art eyeglass holder includes structure for clipping over a top and bottom of the eyeglasses. Although the clip-type eyeglass holder usually strongly secures a pair of eyeglasses, one must be careful that the clip portion of the eyeglass holder does not scratch the glass lenses of the eyeglasses. Furthermore, the clip-type eyeglass holder requires two hands for use, which is also not appropriate for drivers or others who are on-the-go.

U.S. Pat. Nos. 4,976,532; 5,144,345 and 5,260,726, all to Nyman disclose an eyeglass hanger having a loop for encircling an eyeglass nose piece. In this manner, the eyeglass are supported by the nose piece in a horizontal orientation. The Nyman hanger includes an elongated horizontal slit for accepting an elongated U-shaped support bar on which the glasses may be hung for sale display. This type of hanger is also more suitable for sales display than convenient access.

It would be advantageous to provide a convenience eyeglass holder that can hold eyeglasses, including structure that keeps both earpieces folded, and supports the glasses in a secure manner without requiring any substantial attention to place and remove the glasses on the holder. Such an eyeglass holder that does not require intricate threading of the earpieces through apertures or into closable restraints would be more useful for temporary storage on nightstands, on car dashboards or hanging from a rear view mirror, etc., than the foregoing eyeglass holder. According to the invention, an easily used eyeglass stand has an upper limb over which an earpiece may be simply draped by an upper one of the hinges, such that the eyeglasses hang down, and a retaining structure adjacent the eyeglasses and disposed above the lower hinge, which keeps the opposing earpiece from pivoting open from a closed position.

SUMMARY OF THE INVENTION

It is an object of the invention to provide an eyeglass holder for supporting eyeglasses in a vertical position, that is conveniently used to store glasses temporarily for convenient access.

It is another object of the invention to provide an eyeglass holder as described, which can stand alone, such as on a dresser or dash board, or hang from a fixed object, such as a rear view mirror.

It is a further object of the invention to provide an eyeglass holder which retains the eyeglasses at one of two opposite folded hinges, and keeps both earpieces of the eyeglasses closed.

Another object of the invention is to provide an eyeglass holder which is easy to use, such that the eyeglasses can be draped over the holder with very little attention, and are kept closed, and just as easily can be lifted clear of the holder.

These and other objects are accomplished when eyeglasses are hung on an eyeglass holder having a main vertical support, a substantially horizontal limb extending from the support for supporting eyeglasses by one of two hinges, and a vertically offset horizontally extending abutment that engages against an earpiece of the other of the hinges, above the hinge, for keeping the earpiece closed. The upper limb can be rigidly connected to the vertical support and has an upward-opening U-shaped depression preventing horizontal displacement along the limb, preferably near the distal end of the limb. The lower arm is vertically spaced from the upper arm and can have a length equal to that of the upper arm. The lower horizontal abutment can be formed by a lower arm having a forward-opening U-shaped depression aligned vertically with the U-shaped depression of the upper limb and prevents the glasses from swinging, for example when the holder is used in a car.

In a standing embodiment, the vertical support extends a distance beneath the lower, horizontal arm sufficient to exceed the length of the glasses between their hinges. The vertical support terminates at a base that supports the holder upright. In a hanging embodiment, the vertical support extends for a length above the upper limb and terminates in a hook or the like for hanging the holder from a fixed object such as a rear view mirror stem or a control knob or the like.

In either case, for placing the glasses on the holder the user orients the eyeglasses vertically with the upper earpiece at least slightly unfolded and the lower earpiece folded against the eyeglasses. The upper earpiece is draped over the upward-facing U-shaped depression in the limb, at the earpiece-to-lens frame joint and the upper earpiece is folded closed. The glasses are supported by the limb at the glasses hinge joint and hang down due to gravity. The upper earpiece naturally folds down into a closed position. The lower earpiece contacts the lower abutment, which prevents the lower earpiece from opening, and rests in the forward-facing U-shaped depression.

A plurality of such limbs and abutment arms can be provided on the support, for example with two limbs and two abutment arms respectively extending from opposite sides of the main vertical support. This conveniently enables the invention to hold two pairs of eyeglasses.

Instead of an upper hook and/or lower base structure, the vertical support can terminate in a clamp, for additional stability. A number of such variations are possible and will be apparent in view of the following discussion of particular examples and embodiments.

BRIEF DESCRIPTION OF THE DRAWINGS

There are shown in the drawings examples of embodiments of the invention as presently preferred. It should be understood that the invention is not limited to the precise arrangements and instrumentalities shown in the drawings, wherein.

DETAILED DESCRIPTION OF THE PREFERRED EMBODIMENTS

Figure 1:
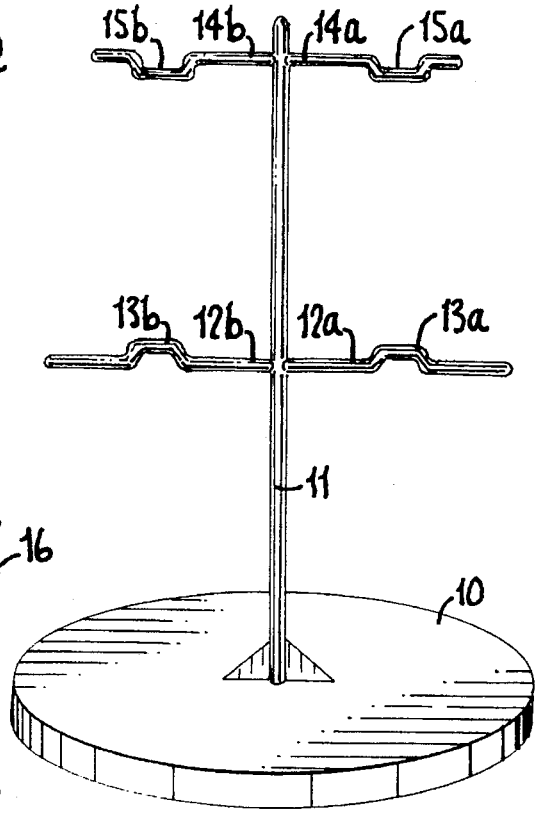
FIG. 1 is a front view of a free-standing embodiment according to the invention.
Figure 2:
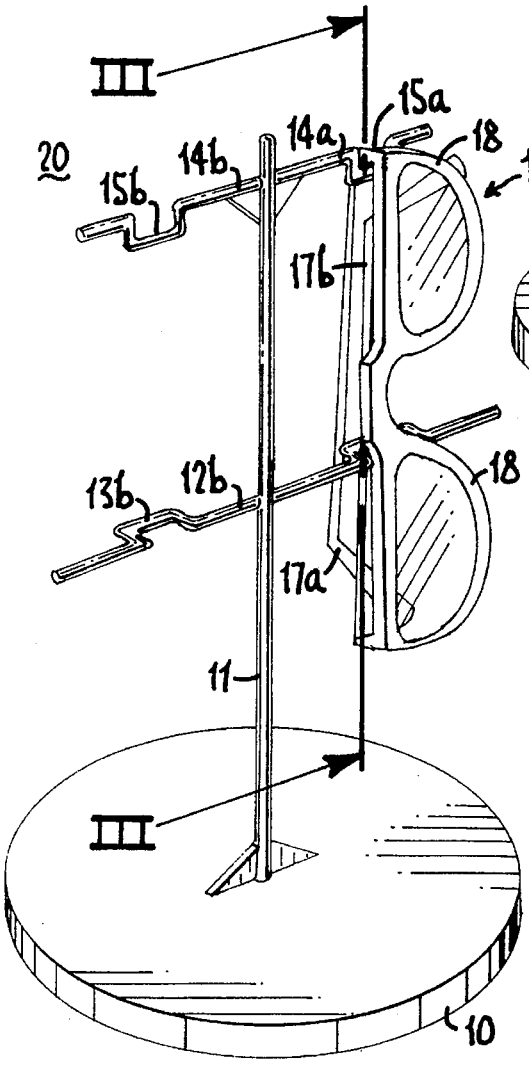
FIG. 2 is a perspective view of a standing embodiment of the invention shown holding a pair of eyeglasses.
Figure 3:
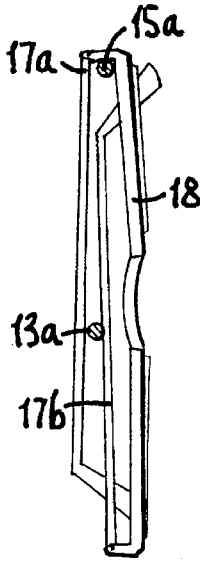
FIG. 3 is a section view taken along lines III—III in FIG. 2.

An embodiment of the invention adapted to stand on a horizontal surface is shown generally in FIGS. 1–3. Base 10 rigidly supports main vertical support 11. Base 10 and vertical support 11 can be fused or molded together; however, base 10 also can be provided with a socket or the like for receiving an end of main vertical support 11, in which case main vertical support 11 can be detachable from base 10.

Vertical support 11 extends substantially perpendicularly from base 10. Upper and lower horizontal limbs or arms extend laterally from vertical support 11, such that the eyeglass holder forms a tree structure. In FIGS. 1–3, the limbs or arms extend oppositely, in a symmetrical structure that can support two pairs of eyeglasses. It is also possible to have limbs or arms extending in only one direction. Whether one or two pairs of eyeglasses are to be supported, the base 10 or other means for positioning vertical support 11 vertically, should be wide, heavy or engaging enough that the support remains vertical when only one pair of eyeglasses is on the holder.

Lower horizontal arms **12*a* and 12*b* extend oppositely from main vertical support 11, preferably substantially at right angles to the longitudinal extension of main vertical support 11. Lower horizontal arms 12*a* and 12*b* have forward-opening depressions 13*a* and 13*b* near their outer ends, forming one means for engaging a pair of eyeglasses when held on the holder. More particularly, arms 12*a* and 12*b* form lower abutments against which one of the earpieces of the eyeglasses rest, thereby holding the eyeglasses vertical, as shown in FIGS. 2 and 3**, and keeping the earpiece with the lower hinge from falling open.

Upper horizontal limbs or arms **14*a* and 14*b* are disposed above lower arms 12*a* and 12*b*, for example at the upper end of main vertical support 11, opposite from base 10. Preferably, upper horizontal arms 14*a* and 14*b* also extend at right angles to main vertical support 11. Upper horizontal arms 14*a* and 14*b* have upward-opening U-shaped depressions or notches 15*a* and 15*b*, positioned over the forward-opening depressions 13*a*, 13*b* of lower arms 12*a*, 12*b***.

Main vertical support 11 holds the upper horizontal arms at a distance above base 10 that is greater than the distance between the earpiece hinges of the eyeglasses to be supported. Also, notches **13*a* and 13*b*, as well as 15*a* and 15*b*, are laterally spaced from one another and from main vertical support 11 by a distance greater than the height of the eyeglasses in a direction perpendicular to the earpieces. This avoids interference between main vertical support 11** and the eyeglasses, or between two pairs of eyeglasses placed on the holder at the same time.

FIGS. 2 and 3 show a pair of eyeglasses in place on the holder. Glasses 16 are suspended on upper horizontal arm **14*a* at notch 15*a*, at the hinge of one of the earpieces 17*a*, which is folded and tends to remain folded due to gravity. Notch 15*a* prevents the eyeglasses from moving laterally of vertical support 11, along arm 14*a*. The lens frame 18 and eyeglass earpiece 17*a* depend vertically downward on opposite sides of horizontal arm 14*a***.

Gravity acts on the other eyeglass earpiece 17*b* in a manner tending to open eyeglass earpiece 17*b* away from eyeglass frame 18. When placing eyeglasses 16 on holder 20, this other earpiece 17*b* is folded closed against eyeglass frame 18 and therefore rests against the forward-facing side of lower horizontal arm 12*a*. Earpiece 17*b* preferably rests within notch 13*a*, whereby the glasses cannot swing laterally and are further held against lateral displacement along arms 12*a*, 14*a*. For this purpose, notches 13*a* and 15*a* are substantially vertically aligned.

The lower horizontal arms 12*a* and 12*b* can be spaced from upper horizontal arms 14*a* and 14*b* by a substantial proportion of the distance between the earpiece hinges, and still tend to keep the lower-hinged earpiece closed. Preferably, however, the upper and lower arms 12*a*, 14*a* are spaced such that lower horizontal arm 12*a* intersects eyeglasses 16 at about the midpoint of eyeglass frame 18, effectively preventing earpiece 17*b* from hinging open away from frame 18 while not interfering substantially with full closing of the upper-hinged earpiece 17*a* against frame 18. This spacing also keeps the eyeglasses secure on the holder.

Figure 4:
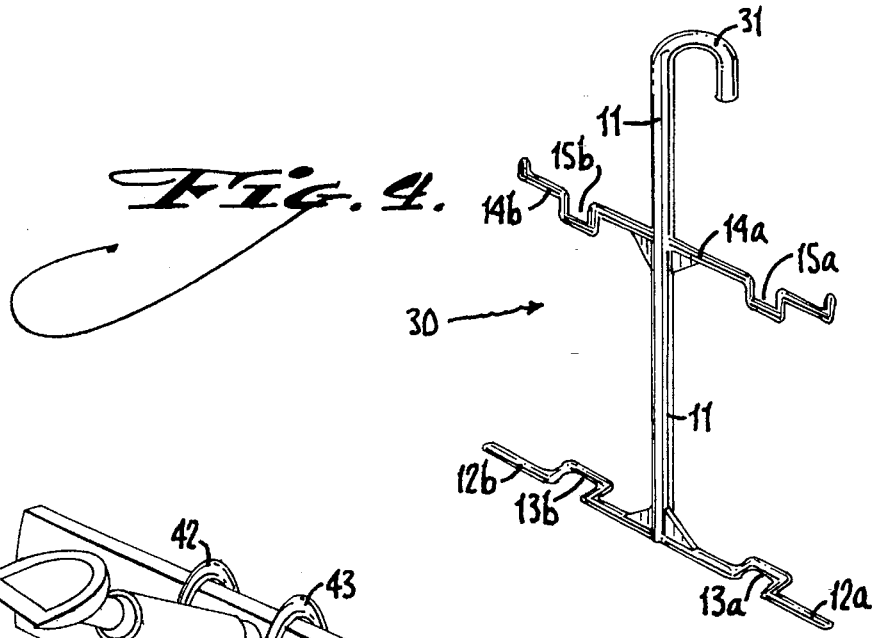
FIG. 4 is a perspective view of a single-hanger hanging embodiment according to the invention.
Figure 5:
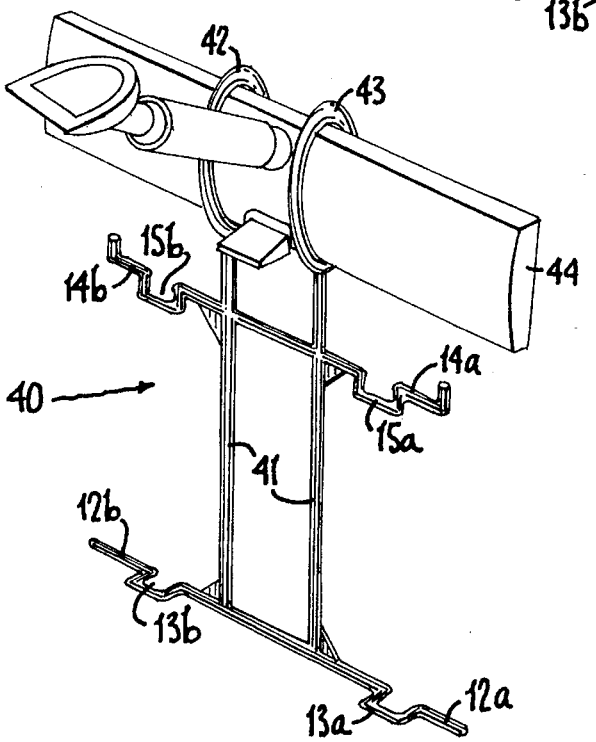
FIG. 5 is a perspective view of a dual hanger hanging embodiment of the invention shown attached to an automobile rear view mirror; and, FIG. 6 is a perspective view of a hanging embodiment of the invention having a pair of C-shaped hanging brackets.
Figure 6:
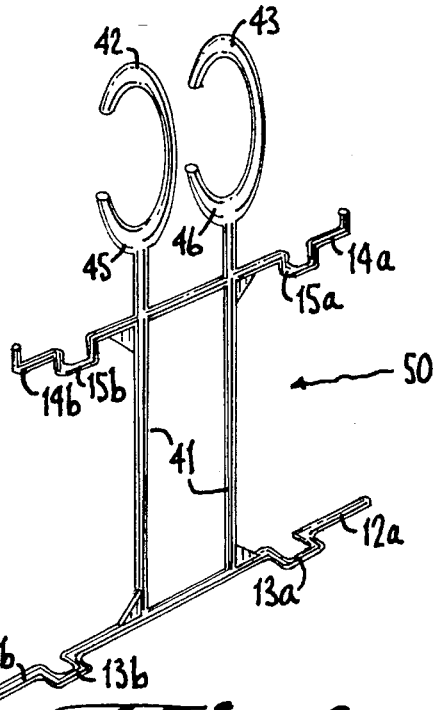

According to another embodiment of the invention as shown in FIGS. 4–6, the upper arm or limb 14*a* and the lower abutment arm 12*a* can be supported from above rather than below, using a hook or clamp arrangement that engages any convenient protrusion or edge surface. In FIG. 4, eyeglass holder 30 has main vertical support 11 terminating at the top in hook 31. Using hook 31, eyeglass holder 30 can be hung from a variety of fixed objects, such as an automobile rear view mirror or visor, a dresser mirror, a wall hook or the like. Hook 31 can extend perpendicular to the plane of the support arms as shown, or can be disposed in the same plane or arranged diagonally, etc. Like the standing embodiments of the invention, eyeglass holder 30 has lower arms 12*a* and 12*b* having notches 13*a* and 13*b*, and upper arms 14*a* and 14*b* having notches 15*a* and 15*b*, for supporting eyeglasses as described above.

FIGS. 5 and 6 illustrate a dual hanger version of the invention, which is especially apt for attachment to a rear view mirror 44 as in FIG. 5. In FIG. 5, the vertical support is formed by a vertical spacer bar 41 fixing lower arms 12*a* and 12*b* and upper arms 14*a* and 14*b* parallel and at the required vertical spacing. Holder 40 has laterally spaced left hook 42 and right hook 43, preferably equidistant from a center point of holder 40, and attached to upper arms 14*a*, 14*b* rather than directly to the vertical support. As shown in FIG. 5, eyeglass holder 40 is optimally designed to be supported by an automobile rear view mirror 44, and due to the lateral spacing of hooks 42, 43, prevents the support from swinging laterally of mirror 44, as could occur with the single hook embodiment of FIG. 4.

Hooks 42 and 43 in FIG. 5 are simply hung over the top of rear view mirror 44, for example on either side of the mirror mounting arm. FIG. 6 illustrates a slightly different eyeglass holder 50, that has a more substantial clamping arrangement for fixing holder 50 to a rear view mirror or the like. Holders 40 and 50 in FIGS. 5 and 6 are shaped to be hung from a fixed, preferably rectangular object, such as a rear view mirror. However, hooks 42 and 43 in eyeglass holder 50 are opposed by lower hooks 45 and 46, that together provide additional support and prevent, for example, front-to-back swinging of eyeglass holder 50 when hanging from, for example, a rear view mirror.

In order to engage holder 50 on a rear view mirror in the manner shown by holder 40 in FIG. 5, it may be necessary to deform one or more of the hooks 42, 43, 45, 46 (i.e., unless holder 50 can be passed laterally over the mirror post). In that case, the holder can be made of a ductile material such as plastic coated wire, which can be bent temporarily as required. Alternatively, the holder can be an integrally molded plastic having sufficient resilience to allow the hanging mechanism to be deformed for engagement on the mirror or the like.

The invention can be embodied using any of various materials, such as molded plastic, wire, plastic or rubber coatings, and combinations thereof. Furthermore, as noted above, the particular length of the arms and the spacing between the arms can vary, within preferred limits as needed to keep the lower-hinged earpiece folded. Furthermore, the spacing of the notches can be varied, within preferred limits as needed to avoid interference. The invention can be embodied with only one set of parallel upper and lower arms, however, it is preferred to include left and right upper and lowers arms for better physical and visual balance and symmetry.

Figure 7:
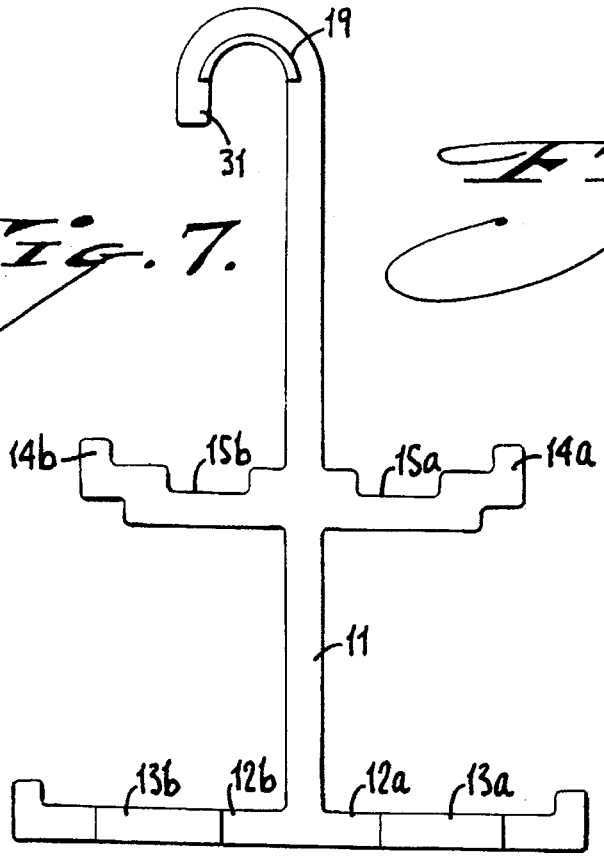
FIG. 7 is an elevation view showing a hanging embodiment of the eyeglass holder formed of substantially flat plastic parts.
Figure 8:
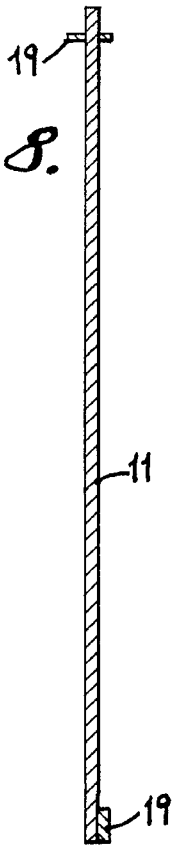
FIG. 8 is an elevation view taken from the right in FIG. 7.
Figure 9:
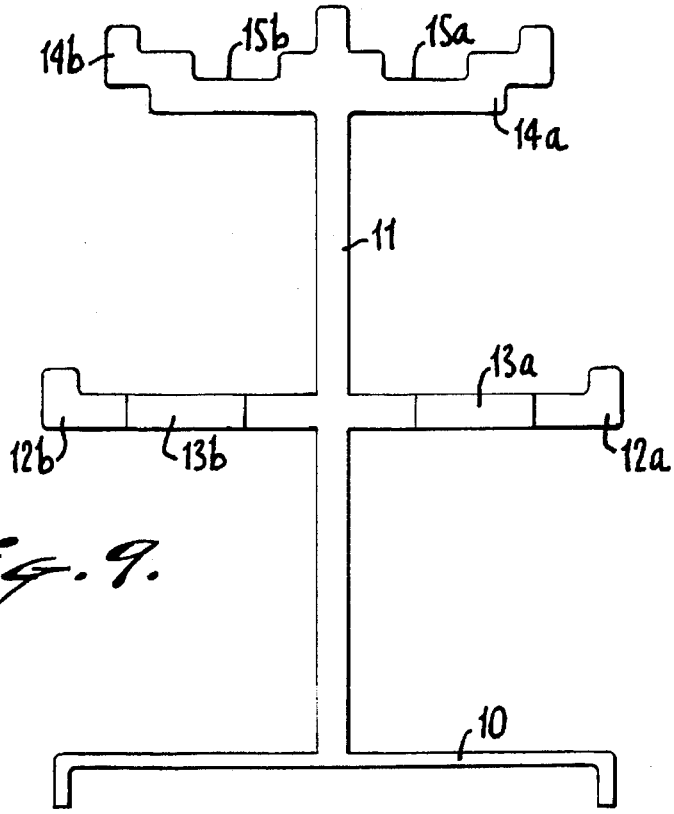
FIG. 9 is an elevation view showing a standing embodiment formed of substantially flat parts affixed on a shallow cylindrical base.

FIGS. 7–9 show a preferred arrangement in which the eyeglass holder of the invention is formed inexpensively using substantially flat plastic parts, the embodiment of FIGS. 7 and 8 being the hanging type and that of FIG. 9 standing on a hollow cylindrical base 10, shaped as a short cylinder.

As in the previous embodiments, the hangers of FIGS. 7–9 have upper and lower arms 14*a*–14*b* and 12*a*–12*b* having upward depressions 15*a*–15*b* in the respective upper arms and forward depressions 13*a*–13*b* in the lower arms. According to these embodiments the hangers are formed in layers of preferably molded plastic that are attached. For example as shown in FIG. 8, the forward depressions 13*a*–13*b* are formed by attaching a strip 19 to the rear of post 11. In addition, the hook 31 is stiffened by the addition of a curved strip 19. Similarly, in FIG. 9, lower depressions 13*a*–13*b* are formed using a rear strip attached to the lower part of post 11.

A number of other possibilities and variations should occur to persons skilled in the art made aware of this disclosure. Reference should be made to the appended claims rather than the foregoing specification as indicating the true scope of the invention.

I claim:

1. An eyeglass holder, for supporting at least one pair of eyeglasses, the eyeglasses having a lens frame and two earpieces which are coupled to respective hinges, the hinges being spaced a distance apart and coupled to the lens frame, the earpieces being hingable between an open and closed position, the holder comprising:

at least one vertical support piece;

at least one upper horizontal arm fixed to said at least one vertical support piece, said at least one upper horizontal arm being dimensioned to fit between the lens frame and an upper-hinged one of the earpieces adjacent a respective upper one of the hinges such that the eyeglasses hang from the upper horizontal arm;

at least one lower horizontal arm fixed to said at least one vertical support piece below said upper horizontal arm, said at least one lower horizontal arm being disposed vertically below said at least one upper horizontal arm and providing an abutment against which a lower-hinged one of the earpieces rests, said upper and lower horizontal arms being spaced by a distance less than the distance between the hinges, whereby the lower-hinged one of the earpieces is prevented from falling into the open position by the abutment without interfering with placing and removing the eyeglasses from the holder; and, further comprising at least one notch formed in at least one of the upper horizontal arm and the lower horizontal arm, said notch retaining the eyeglasses against lateral displacement relative to the at least one vertical support.

2. An eyeglass holder, for supporting at least one pair of eyeglasses, the eyeglasses having a lens frame and two earpieces which are coupled by respective hinges to the lens frame, the holder comprising:

at least one vertical support piece;

at least one upper horizontal arm fixed to said at least one vertical support piece, said at least one upper horizontal arm being dimensioned to fit between the lens frame and an upper-hinged one of the earpieces adjacent a respective upper one of the hinges such that the eyeglasses hang from the upper horizontal arm;

at least one lower horizontal arm fixed to said at least one vertical support piece below said upper horizontal arm, said at least one lower horizontal arm being disposed vertically below said at least one upper horizontal arm and providing an abutment against which a lower-hinged one of the earpieces rests, said upper and lower horizontal arms being spaced by a distance less than a distance between the hinges, whereby the lower-hinged one of the earpieces is held closed by the abutment without interfering with placing and removing the eyeglasses from the holder;

at least one notch formed in at least one of the upper horizontal arm and the lower horizontal arm, said notch retaining the eyeglasses against lateral displacement relative to the at least one vertical support;

wherein the upper horizontal arm has an upward-opening notch for engaging with the upper one of the hinges, and the lower horizontal arm has a forward-opening notch disposed substantially vertically under the upward opening notch for engaging with the lower-hinged earpiece.

3. The eyeglass holder of claim 1, further comprising a base fixed to an end of said at least one vertical support piece for securing said at least one support piece in an upright position.

4. The eyeglass holder of claim 3, wherein said base is removable from the vertical support piece.

5. The eyeglass holder of claim 1, wherein said at least one lower horizontal arm is separated from said at least one upper horizontal arm by approximately one-half of the distance between the hinges.

6. The eyeglass holder of claim 1, wherein the upper horizontal arm comprises a pair limbs extending in opposite directions from the vertical support piece, each said limb having an upward-opening notch for engaging the upper hinge, and wherein the lower horizontal arm comprises a pair of said abutments extending in opposite directions from the vertical support piece substantially vertically under said pair of limbs, each of the abutments having a forward-opening notch for engaging the lower-hinged earpiece, the upward-opening and forward-opening notches retaining the eyeglasses against lateral displacement.

7. The device of claim 1, wherein said vertical support piece terminates in a hook whereby the holder may be hung from a fixed object.

8. A holder for at least one pair of eyeglasses, in combination with at least one pair of eyeglasses wherein:

the at least one pair of eyeglasses has a lens frame and two earpieces coupled to respective hinges, the hinges being spaced a distance apart and coupled to the lens frame, the earpieces being hingable between an open and closed position, the holder has an upper horizontal arm dimensioned to fit between the lens frame and one of the earpieces adjacent an upper one of the hinges when folded, such that the eyeglasses hang from the upper horizontal arm;

a vertical spacer affixed to the upper horizontal arm;

a lower horizontal arm affixed to the vertical spacer and disposed substantially vertically under the upper horizontal arm, said lower horizontal arm providing an abutment against which a lower-hinged one of the earpieces rests, said upper and lower horizontal arms being spaced by a distance less than the distance between the hinges, whereby the lower-hinged one of the earpieces is prevented from falling into the open position by the abutment without interfering with placing and removing the eyeglasses from the holder.

9. The combination of claim 8, further comprising at least one notch formed in at least one of the upper horizontal arm and the lower horizontal arm, said notch retaining the eyeglasses against lateral displacement relative to the at least one vertical support.

10. The combination of claim 9, wherein the upper horizontal arm has an upward-opening notch for engaging with the upper one of the hinges, and the lower horizontal arm has a forward-opening notch disposed substantially vertically under the upward opening notch for engaging with the lower-hinged earpiece.

11. The combination of claim 8, further comprising a base attached to one of said upper and lower horizontal arms and said vertical support piece, for supporting the holder on a horizontal surface.

12. The combination of claim 8, further comprising attachment means extending upwardly from one of said upper and lower horizontal arms and said vertical support piece, for suspending the holder from a fixed edge.

13. The combination of claim 12, further comprising a pair of hooks fixed to said upper horizontal arm, said pair of hooks laterally disposed equidistantly from said vertical spacer bar.

14. The combination of claim 13, wherein each of said hooks is substantially C-shaped.

15. The combination of claim 13, wherein the hooks are dimensioned to engage over a rear view mirror.

16. The combination of claim 8, wherein said upper and lower arms are separated by a distance approximately equal to one-half of a distance between the hinges.

* * * * *